United States Patent [19]

Hauffe et al.

[11] Patent Number: 5,039,361

[45] Date of Patent: Aug. 13, 1991

[54] PROCESS OF PHOSPHATING METAL SURFACES

[75] Inventors: Dieter Hauffe, Frankfurt am Main; Jörg Hieke, Eschborn; Rudolf Vey, Bad Vilbel; Günter Siemund, Heusenstamm; Han-Yong Oei, Frankfurt am Main, all of Fed. Rep. of Germany

[73] Assignee: Metallgesellschaft Aktiengesellschaft, Frankfurt am Main, Fed. Rep. of Germany

[21] Appl. No.: 443,212

[22] Filed: Nov. 28, 1989

[30] Foreign Application Priority Data

Dec. 2, 1988 [DE] Fed. Rep. of Germany ..... 3840668

[51] Int. Cl.[5] ..... C23C 22/77

[52] U.S. Cl. ..... 148/253; 148/259; 148/262; 134/13

[58] Field of Search ..... 148/253, 259, 262; 134/13

[56] References Cited

U.S. PATENT DOCUMENTS 3,874,951 4/1975 Hill ..... 148/253
3,992,300 11/1976 Hill ..... 148/253

FOREIGN PATENT DOCUMENTS 0040369 11/1981 European Pat. Off. .
0045110 11/1981 European Pat. Off. .
0042631 10/1984 European Pat. Off. .
1184592 12/1964 Fed. Rep. of Germany .
2241798 3/1974 Fed. Rep. of Germany .
3345498 6/1985 Fed. Rep. of Germany .
932987 7/1963 United Kingdom .
996418 6/1965 United Kingdom .
1555529 11/1979 United Kingdom .
2078788 1/1982 United Kingdom .
2080835 2/1982 United Kingdom .

*Primary Examiner*—Jay H. Woo
*Assistant Examiner*—Jeremiah F. Durkin, II
*Attorney, Agent, or Firm*—Felfe & Lynch

[57] ABSTRACT

During a method of phosphating a metal surface which includes at least in part iron or steel and is dipped into or flooded with a phosphating solution which contains layer-forming cations and nitrate or equivalent accelerators, the iron content is limited by a precipitation of iron phosphate. A partial volume of the phosphating solution is intermittently withdrawn from the bath tank and in a separate aerator is contacted with oxygen or an oxygen-containing gas. The iron phosphate sludge is removed from the resulting solution, which is then returned to the bath tank. The partial volume of the phosphating solution is supplied from below into and is aerated in an aerator, which is provided with an aspirating aerating agitator and which is tapered at least in its lower portion. When the aerator has been terminated, the phosphating solution which has been depleted of iron(II) is sucked off upwardly and is returned to the bath tank.

10 Claims, 1 Drawing Sheet

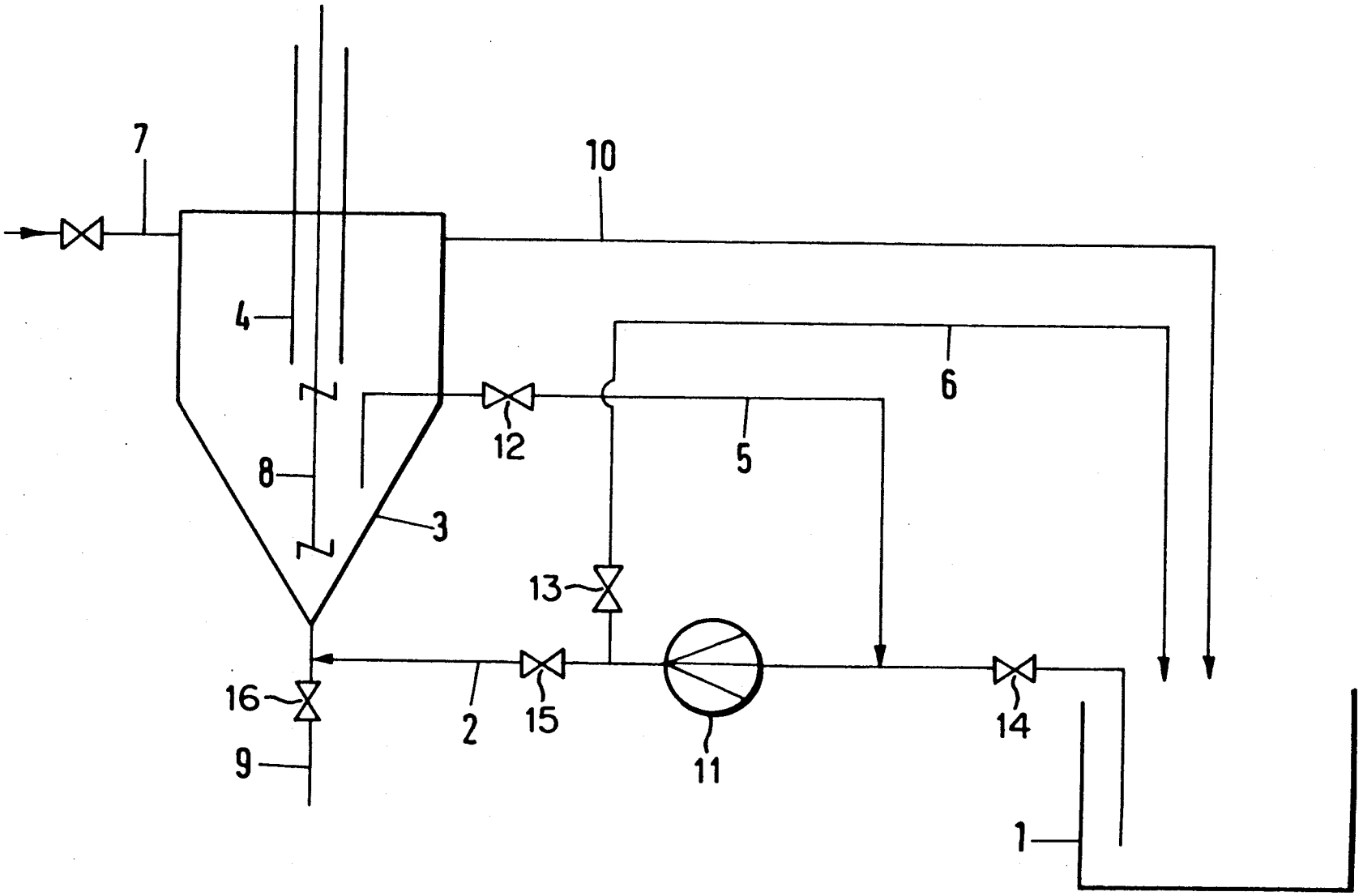
1
2
3
4
5
6
7
8
9
10
11
12
13
14
15
16

PROCESS OF PHOSPHATING METAL SURFACES

BACKGROUND

The present invention relates to a process carried out in conjunction with the phosphating of a metal surface which consists, at least in part, of iron or steel and is dipped into, or flooded with, a phosphating solution. The solution contains layer forming cations and nitrate or equivalent accelerators. The iron content of the solution is limited by the precipitation of iron phosphate in that a partial volume of the phosphating solution is intermittently withdrawn from the bath tank and is contacted with oxygen or an oxygen-containing gas in a separate aerator. Iron phosphate sludge is removed from the resulting solution and the solution is then returned to the bath tank.

In the formation of a phosphate coating on a metal surface by a treatment with, e.g., a zinc phosphate solution, it is common practice to add one or more oxidizers to the phosphating solution to accelerate the formation of the layer. In the formation of phosphate coatings on iron or steel surfaces, special problems arise because iron is dissolved and initially forms iron(II) ions in solution.

In one category of phosphating processes, the phosphating solutions used contain oxidizers for transforming iron(II) to iron(III) so that an insoluble iron phosphate is formed. As additional surface area is treated, sludge forms in considerable amounts and must be removed by physical separation. Difficulties are involved in the removal of the sludge in some processes so that it is more desirable to control the phosphating process so as to preclude, or minimize, the formation of sludge.

In the phosphating processes of that category, which are said to be carried out "on the iron side", the phosphating solution contains chemicals which do not transform dissolved iron to a trivalent state. This is effected by the use of e.g., nitrate, or a similarly weak oxidizer as accelerator.

Whereas in the phosphating processes carried out "on the iron side" the formation of sludge is substantially suppressed, such processes involve other disadvantages. For instance, because a strong oxidizer is absent, the phosphate layer forms slowly. Since the solution is enriched with iron(II) phosphate, the content of iron phosphate in the resulting phosphate layer may become undesirably high and the formed phosphate layers tend to be coarse-grained.

Numerous attempts have been made to eliminate these various problems. For instance, in the process in accordance with GB-A-996,418, urea is added to the phosphating bath so that the phosphating can be carried out at a higher temperature without the risk of the formation of much more sludge. While that process results in a faster formation of the phosphate layer, the other mentioned disadvantages remain. An additional disadvantage is the phosphating solution must be heated and this otherwise unrequired heating consumes additional energy.

In a different bath of the type which is not operated "on the iron side", it has been attempted to solve the sludge problem by increasing the solids content of the sludge so that less sludge is formed (GB-A-1,555,529). Whereas a compact sludge is obtained and the interval between the times at which the treating apparatus must be desludged is increased, it has been found that it may be more difficult to remove compact sludge rather than light-weight, bulky sludge.

It is known from EP-A-45 110 to form phosphate layers on iron or steel surfaces, which are dipped into, or flooded with, solutions which have a defined composition and in which an iron(II) content of 0.05 to 1% by weight is adjusted by the addition of a suitable amount of $ClO_3$ or a similarly acting accelerator, which oxidizes iron(II) to iron(III).

In another process of phosphating a metal surface which consists at least in part of iron or steel and is dipped into or flooded with phosphating solutions which contain layer-forming cations, particularly zinc cations, and nitrate or equivalent accelerators, a partial volume of the phosphating solution is withdrawn from the bath tank, oxidizers are added to that partial volume in a separate device to effect a precipitation of iron phosphate, and iron phosphate sludge is removed from the resulting solution. The solution is then returned to the tank. Iron phosphate is mainly precipitated by an addition of chlorate and/or hydrogen peroxide. The amount of precipitated iron phosphate is desirably controlled so that the iron content of the phosphating solution in the bath tank is not in excess of the content of the cation which determines the type of layer formed (DE-A-33 45 498).

Whereas the two last mentioned processes are satisfactory as regards the control of the iron(II) content of the phosphating solution, handling of the phosphate sludge which is formed is not solved in a satisfactory manner.

It is an object of the present invention to provide a process which is carried out in conjunction with a metal surface consisting at least in part of iron or steel and which is free of the known disadvantages, particularly those mentioned hereinbefore, does not require additional chemicals, can be carried out in a simple manner without adversely affecting the quality of the layer, does not require a substantial apparatus expenditure and permits a simple handling of the sludge.

BRIEF DESCRIPTION OF THE DRAWING

The Figure schematically represents an arrangement for a system for practicing the invention.

THE INVENTION

The above-described objects and others are obtained in that the process which is of the kind described first hereinbefore is carried out in accordance with the invention in such a manner that a partial volume of the phosphating solution is introduced from below into and aerated in an aerator by means of an aspirating aerating agitator which is tapered at least in its lower portion, the resulting iron phosphate is permitted to settle when the aeration has been terminated, and the phosphating solution which has been depleted of iron(II) is sucked off upwardly and returned to the bath tank (1).

In a preferred embodiment, the aeration is obtained.

The provision of an aerator having an aspirating aerating agitator affords the advantage that the oxygen-containing gases which are required need not be introduced by other means, which would require an expensive apparatus.

The taper of the aerator at least in its lower portion permits an improved settling and a simpler removal of the iron phosphate sludge.

The upward suction removal of the phosphating solution depleted of iron(II) affords the advantage that the amount of iron phosphate which is entrained by the regenerated solution into the bath tank is minimized.

The dimensions of the aerator will particularly depend on the volume of the phosphating bath to be treated and on the load of the phosphating bath, i.e., the throughput rate. Space availability and access for maintenance work must also be considered.

The speed of the aerating agitator will depend to some extent on the size of the aerator. It preferably should exceed 800 r.p.m., so that the rate at which air is aspirated and the dispersion of the air in the aerator will be sufficient. It is particularly desirable to use aerating agitators rotating at a speed of about 1200 to 1500 r.p.m. It is essential that the aerating agitator disperses the oxygen-containing gas in the phosphating solution in the form of bubbles which are as fine as possible.

The amount of iron which is removed or precipitated will substantially depend on the type of layer which is to be formed by the phosphating process. The minimum amount is determined by the iron content at which a disturbance of the formation of the layer begins (about 12 to 13 g/liter). As a rule, the concentration will be much lower, e.g., in the range of 6 to 8 g/l.

It is generally desirable to control the amount of iron which is precipitated so that the iron content of the phosphating solution in the bath tank is not in excess of the content of the cation which determines the type of the layer to be formed, provided that this is not in excess of the permissible content which has been set forth hereinbefore.

It is generally recommended to withdraw a partial volume, e.g., 5 to 10%, of the total volume from the phosphating bath and to treat the partial volume so that the intervals of time between such withdrawals may be rather long. Alternatively, a relatively small partial volume of, e.g., 3 to 7%, may be treated within relatively short intervals of time. The mode of operation will generally depend on the total volume of the phosphating bath, i.e., on the throughput rate.

A plurality of phosphating baths may be regenerated by the process in accordance with the invention.

The process in accordance with the invention can be carried out with special advantage for a treatment of a phosphating solution in which the layer-forming cation consists predominantly of zinc optionally in the presence of manganese and/or calcium.

It is also desirable to use phosphating solutions at a temperature between 35° and 70° C., preferably between 45° and 55° C. Experience has shown that there will be no oxidation of iron, i.e., no precipitation of iron phosphate, at such temperatures by nitrate or equivalent accelerators. Besides, phosphating processes can be carried out more economically at such temperatures because the energy requirement is reduced.

A phosphating solution which can be used in the phosphating process contains, e.g., at least 0.3% by weight Zn, at least 0.3% by weight $PO_4$ and at least 0.75% by weight $NO_3$ or a similarly acting accelerator which will not oxidize iron(II) and said solution has a Zn:$PO_4$ weight ratio in excess of 0.8 and a ratio of total acid to free acid of at least 5. Specifically, the solution contains up to 2.2% by weight Zn, up to 2.2% by weight $PO_4$ and up to 5.5% by weight $NO_3$ or a similarly acting accelerator. In particular the Zn:$PO_4$ weight ratio is less than 4 and the ratio of total acid to free acid is not in excess of 30. Further details are described in EP-A-45 110.

In another process which may be carried out, the metal surface is contacted at treating temperatures of 50° to 98° C. with a phosphating solution which contains at least 0.6 g/l, preferably 1 g/l, manganese ions and in which the weight ratio $P_2O_5$: $NO_3$=1: (0.3 to 3.0), total $P_2O_5$: free $P_2O_5$=1: (0.25 to 0.70), Mn: Zn=1: (22 to 0.2), preferably 1: (12 to 0.8) and which, in a steady state, contains at least 20 total acid points.

The phosphating solution may additionally contain simple and/or complex fluorides, such as NaF, $NaHF_2$ and/or $Na_2SiF_6$ and may be replenished with zinc ions, manganese ions, phosphate ions and nitrate ions in a weight ratio of $P_2O_5$: $NO_3$=1: (0.3 to 2.0), total $P_2O_5$: free $P_2O_5$=1: (0.3 to 0.8), Mn: Zn=1: (2 to 80) (EP-A-42 631).

Examples of other suitable phosphating solutions are described in DE-C-22 41 798 and DE-B-11 84 592.

In a preferred embodiment of the invention a plurality of charges are subjected to a precipitating treatment before the iron phosphate sludge, which has mainly deposited in the tapered portion of the aerator, is dispersed in water by means of a stirrer, which extends into the tapered portion. This processing affords the advantage that the throughput rate of the phosphating solution is increased because it is not necessary to discharge the settled phosphate sludge after each settling phase. It is particularly advantageous in that embodiment of the invention to introduce the phosphating solution to be treated from below because this will result in an agitation of the iron phosphate sludge separated during the preceding precipitating treatment or treatments and avoid or minimize a caking of solids on the container wall.

The stirrer used to agitate the settled iron phosphate sludge in water may basically be arranged as desired and may be separately arranged. It is particularly desirable, in an embodiment of the invention, to disperse the phosphate sludge by a stirrer which has a shaft that is coaxial to the aerating agitator. The iron phosphate sludge, which has been dispersed in water, is usually discharged through the bottom outlet of the aerator into the sewer leading to the neutralizing plant after a stirring time of about 10 minutes. If such a neutralizing plant is not available, the resulting sludge, in a suitable embodiment of the invention, may be neutralized in the aerator and may then be drained.

By means of the process in accordance with the invention the iron content of phosphating solution which is used on the iron side can be maintained constant within narrow limits by means of inexpensive apparatus. There is no need for additional chemicals for oxidizing the iron(II) to iron(III). By the ingenious supply of the phosphating solution to be regenerated to the aerator from below, the formation of a firmly adhering iron phosphate crust, which could be removed only with difficulty, is retarded, particularly in the embodiment of the invention in which a plurality of precipitating treatments are carried out. The performance of a plurality of precipitating treatments has the considerable further advantage that the quantity of water required is much smaller than the large quantity usually employed.

Referring to the Figure, a phosphating solution is intermittently pumped from the phosphating bath 1 into the aerating vessel 3 through the line 2 and the bottom outlet, e.g., by means of a pneumatic diaphragm pump 11. That pumping is continued until the aerating vessel 3 has been filled to the desired level. During the stage of filling vessel 3, valves 12, 13 and 16 are closed and valves 14 and 15 open. The aerating agitator 4 is then started and is operated until the desired amount of iron phosphate sludge has been precipitated.

When the aeration has been terminated, the resulting iron phosphate sludge is permitted to settle and the regenerated phosphating solution is subsequently sucked off through line 5 and is supplied via line 6 to the phosphating bath 1. During sucking off valves 14, 15 and 16 are closed and valves 12 and 13 open. Preferably after a plurality of precipitating treatments, fresh water is supplied through line 7 to the aerator 3 and the stirrer 8 is started. When all of the settled iron phosphate sludge has been dispersed, the slurry is withdrawn through line 9 by opening valve 16, optionally after it has been neutralized. An emergency overflow line is designated 10.

EXAMPLE

Cold-headable wire made of various grades of steel was treated in the following processing sequence:

1. Degreasing.
2. Rinsing by dipping into cold water.
3. Pickling in 20% by weight sulfuric acid at a temperature of 65° C. for about 20 minutes. The pickling bath contained 0.5 g/liter inhibitor.
4. Rinsing with cold water.
5. Activating prerinse in a dispersion of titanium orthophosphate.
6. Phosphating at 50° C. for 10 minutes.
7. Rinsing with cold water.
8. Neutralizing rinse.
9. Application of soap from a sodium soap solution having a concentration of 5% by weight.
   Temperature of the soap solution 75° C.
   Duration of treatment 3 minutes.
10. Drying of the cold-headable wire with air.

The cold-headable wires were cold-worked after that treatment.

The phosphating in step 6 was effected by a phosphating solution which had the following initial composition:

18.3 g/l zinc;
15.0 g/l phosphate (calculated as $P_2O_5$); and
33.8 g/1 nitrate. The number of total acid points was 64.

To maintain the phosphating solution in a phosphating condition, the bath was replenished to a constant number of total acid points with a replenishing solution which contained 12.1% by weight zinc;
24.4% by weight phosphate (calculated as $P_2O_5$); and
11.3% by weight nitrate.

The container of the aerator 3 had an overall height of 1500 mm and its cylindrical portion was 800 mm in diameter. The conical bottom of the container had an inclination of 60°. The capacity of the aerator to the overflow amounted to 470 liters.

The aerating vessel was provided with an aspirating aerating agitator 4, of the Firm of TURBO MÜLLER, type BOF 4/02, which had a speed of 1400 r.p.m. It was immersed in a depth of 500 mm and was operated at an aerating rate of about 7 $m^3$/h.

The phosphating bath consisted of 6 $m^3$ phosphating solution. When the iron content of the phosphating solution amounted to about 6 g/l, 450 liters of that solution were supplied to aerator 3 and were contacted therein with air for an aerating time of 30 minutes. Owing to the suction rate mentioned above, the supply of air amounted to 0.78 $m^3$/100 liters of phosphating solution.

After the aeration, the resulting iron phosphate sludge was permitted to settle for 6 minutes. The separation was mainly effected in the conical portion of the vessel. When the settling had been terminated, the phosphating solution was sucked off through line 5 and was recycled into the phosphating bath 1 through line 6. After the sucking, a residual volume of about 30 liters phosphating solution was still contained in the aerating container 3.

After five precipitating treatments, the aerator 3 was supplied through line 7 with about 80 liters fresh water and the stirrer 8 was started. The aerating agitator 4 is not operated during the operation of the stirrer 8. After a stirring time of 10 minutes, the iron phosphate sludge, which had mainly settled in the conical portion of the aerator 3, had been dispersed and could be drained and neutralized.

By means of the process in accordance with the invention it was possible to maintain the iron content of the phosphating solution, amounting to about 6 $m^3$, at a constant value of about 6 to 7 g/l in a bath having an average throughput rate of 800 $m^2$/8 h.

It will be understood that the specification and examples are illustrative but not limitative of the present invention and that other embodiments within the spirit and scope of the invention will suggest themselves to those skilled in the art.

We claim:

1. A process carried out in conjunction with a phosphating of a metal surface which consists at least in part of iron or steel and is dipped into, or flooded with, a phosphating solution which contains layer forming cations and nitrate or equivalent accelerators and the iron content of the solution is limited by a precipitation of iron phosphate comprising: intermittently withdrawing a partial volume of the phosphating solution from a tank containing the phosphatizing solution; introducing the partial volume into an aerator at a lower section thereof; contacting the partial volume with oxygen or oxygen-containing gas in the aerator tapered at least at its lower portion to aerate the solution by means of an aspirating aerating agitator; settling the iron phosphate from the aerated solution; thereafter sucking off upwardly the aerated solution from which the iron phosphate has been settled and returning said solution to the tank; and dispersing said iron phosphate to form an aqueous suspension.

2. The process of claim 1 wherein a plurality of charges are subjected to a precipitating treatment before the iron phosphate is dispersed in water by means of a stirrer which extends into the tapered portion of the aerator.

3. The process of claim 2 wherein the iron phosphate is dispersed by means of a stirrer, which has a shaft that is coaxial to the aerating agitator.

4. The process of claim 3 wherein the resulting dispersion is neutralized in the aerator.

5. A process of limiting the iron content of a phosphating solution in a system for phosphating a metal surface which consists at least in part of iron or steel and which is dipped into, or flooded with a phosphating solution which contains layer forming cations and an accelerator comprising: intermittently withdrawing a partial volume of the phosphating solution from a tank containing the phosphating solution; introducing the partial volume into an aerator at a lower section thereof; contacting the partial volume with oxygen or oxygen-containing gas in the aerator tapered at least at its lower portion to aerate the solution by means of an aspirating aerating agitator; settling the iron phosphate from the aerated solution; thereafter sucking off upwardly the aerated solution from which the iron phosphate has been settled and returning said solution to the tank; and dispersing said iron phosphate to form an aqueous suspension.

6. The process of claim 5 wherein a plurality of charges are subjected to a precipitating treatment before the iron phosphate is dispersed in water by means of a stirrer which extends into the tapered portion of the aerator.

7. The process of claim 6 wherein the iron phosphate is dispersed by means of a stirrer, which has a shaft that is coaxial to the aerating agitator.

8. The process of claim 7 wherein the resulting dispersion is neutralized in the aerator.

9. The process of claim 4 wherein the resulting dispersion is neutralized in the aerator by the addition of an alkaline material.

10. The process of claim 8 wherein the resulting dispersion is neutralized in the aerator by the addition of an alkaline material.

* * * * *